US006582027B1

(12) United States Patent
Umeno

(10) Patent No.: US 6,582,027 B1
(45) Date of Patent: Jun. 24, 2003

(54) BRUSH FOR COSMETIC TOOL OR WRITING INSTRUMENT AND PRODUCTION PROCESS FOR THE SAME

(75) Inventor: Takashi Umeno, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 369 days.

(21) Appl. No.: 09/628,087

(22) Filed: Jul. 28, 2000

(30) Foreign Application Priority Data

Aug. 25, 1999 (JP) ..... 11-237999

(51) Int. Cl.[7] ..... A46B 1/00; A46D 1/00

(52) U.S. Cl. ..... 300/21; 15/180; 15/186; 15/187; 15/188; 15/190; 15/191.1; 15/193; 300/4; 300/5; 300/7; 300/8

(58) Field of Search ..... 300/21, 4–5, 7–8; 156/180; 15/186, 190, 191.1, 192, 193, 187, 188, 207.2

(56) References Cited

U.S. PATENT DOCUMENTS 3,689,118 A * 9/1972 Charvat et al. ..... 300/21
3,840,932 A * 10/1974 Balamuth et al. ..... 15/167.1
3,864,183 A 2/1975 Hori ..... 156/273
4,807,938 A * 2/1989 Weihrauch ..... 300/21
4,892,698 A * 1/1990 Weihrauch ..... 300/21
5,052,419 A * 10/1991 Olsen ..... 264/243
5,133,590 A * 7/1992 Fitjer ..... 15/160
5,197,496 A * 3/1993 Nakamura ..... 132/200
5,474,366 A * 12/1995 Strutt et al. ..... 300/21
5,622,411 A * 4/1997 Weihrauch ..... 264/243
5,765,927 A * 6/1998 Lewis, Jr. ..... 300/21

FOREIGN PATENT DOCUMENTS

JP 05207912 8/1993

* cited by examiner

*Primary Examiner*—Robert J. Warden, Sr.
*Assistant Examiner*—S Balsis
(74) *Attorney, Agent, or Firm*—Darby & Darby

(57) ABSTRACT

Provided is a production process of a brush, comprising a consecutive combination of:

(a) a step of bundling a prescribed number of fibers to form a long-size fiber bundle in which the whole is temporarily bound, (b) a step of cutting the long-size fiber bundle to a prescribed size, (c) a step of completely binding the tail end part of the cut fiber bundle by a thermally fusing means, (d) a step of dipping the fiber bundle in which the tail end part is completely bound in a solvent to remove the resin adhered to unbind the fibers other than those in the tail end part of the fiber bundle.

3 Claims, 6 Drawing Sheets

BRUSH FOR COSMETIC TOOL OR WRITING INSTRUMENT AND PRODUCTION PROCESS FOR THE SAME

BACKGROUND OF THE INVENTION

1. Field of the Invention

The present invention relates to a production process of a brush for a cosmetic tool such as a manicure or a writing instrument such as a brush-tip pen, which can contain an increased amount of a coating liquid, and uses of the brush do not specifically matter.

2. Description of the Related Art

A conventional production process for a brush which has so far been employed includes a process in which a suitable number of short fibers is set to a desired length and is tied up in a bundle and then the end parts thereof are put in order, and in which the rear end part thereof is bound by melting and then the tip part thereof is cut to an even face. In such a conventional process, a method in which all fibers are surely stuck to a melting end part is employed when monofilaments themselves are straight fibers, and therefore the work is complicated. In addition thereto, it is difficult to put the end part thereof in order, and the fibers which can not completely be stuck fall off, so that the number of fibers in the brush is scattered in a certain case. In the case of a brush in which monofilaments themselves are not straight fibers and comprise crimp fibers having twists, an opening formed between the fibers is enlarged as compared with that formed between the straight fibers, and it is very difficult to stick all fibers surely to the melting end part.

That is, crimp fibers are liable to get intertwined with each other due to twists thereof, and therefore when the end part of the respective fibers cut to a desired length is intended to be put in order in a state of a bundle, the intertwining of the fibers themselves makes it difficult to put the end part of the respective fibers in order. When the end part of a fiber bundle is bound by melting in such a state that the end part is not well put in order as described above, the fibers which are not stuck to the melting end part remain in the brush, and the problem that the fibers fall off from the brush is caused (refer to FIG. 1 and FIG. 12 attached), so that a fiber density of the brush is not stabilized and the brush which is not provided with a desired holding capacity of a coating liquid is obtained. Further, the fibers are insufficiently stuck, and therefore it is observed much often that the fibers fall off from the brush while applying a coating liquid.

In such conventional processes, not only in the case of crimp fibers but also in the case of straight fibers, there have been the problems in that it is difficult to process the tip part of a brush into a desired shape and scattering in a full length of fibers constituting the brush is caused and in that when a flange is disposed in the rear end part of the brush, it is difficult to form the flange in a required size without requiring an ancillary part, which allows the number of the parts to grow larger. An object of the present invention is to solve such problems as described above and to provide an efficient production process suited to a brush of a high quality, particularly a brush comprising crimp fibers in which an opening formed between the fibers is large and in which a quantity of a coating liquid held therein is increased.

SUMMARY OF THE INVENTION

The present invention has been as a result of various investigations continued in order to solve the problems described above and relates to a production process for a brush, comprising bundling parallel a prescribed number of fibers, temporarily binding the whole thereof by a resin or waxes (hereinafter referred to simply as resins) to form a long-size fiber bundle, cutting the above fiber bundle to a prescribed length, completely binding the tail end part of the cut fiber bundle and then dissolving and removing the resin present in the parts other than the finally bound end part to unbind the fibers.

That is, the present invention relates to a production process of a brush for a cosmetic tool or a writing instrument, comprising a consecutive combination of:

(a) a step of bundling a prescribed number of fibers into a desired diameter, applying a liquid resin or waxes at least on the peripheral surface thereof and then drying it to form a long-size fiber bundle in which the whole is temporarily bound, (b) a step of cutting the temporarily bound long-size fiber bundle to a prescribed size, (c) a step of completely binding the tail end part of the cut fiber bundle by a thermally fusing means in a state of fixing the fiber bundle, and (d) a step of dipping the fiber bundle in which the tail end part is completely bound into a solvent capable of dissolving the resin or wax used in the step (a) described above to dissolve and remove the resin or wax adhered to unbind the fibers other than those in the tail end part of the fiber bundle, and if necessary, a step of drying this fiber bundle after taking it out of the solvent.

DETAILED DESCRIPTION OF THE PREFERRED EMBODIMENTS

The embodiment of the present invention shall be explained below in detail with reference to the attached drawings.

First, in the step (a), a prescribed number of fibers is bundled into a desired diameter, and a liquid resin is applied at least on the peripheral surface thereof, preferably on the whole fibers, followed by drying it to form a long-size fiber bundle in which the whole is temporarily bound by the resin.

Figure 1:
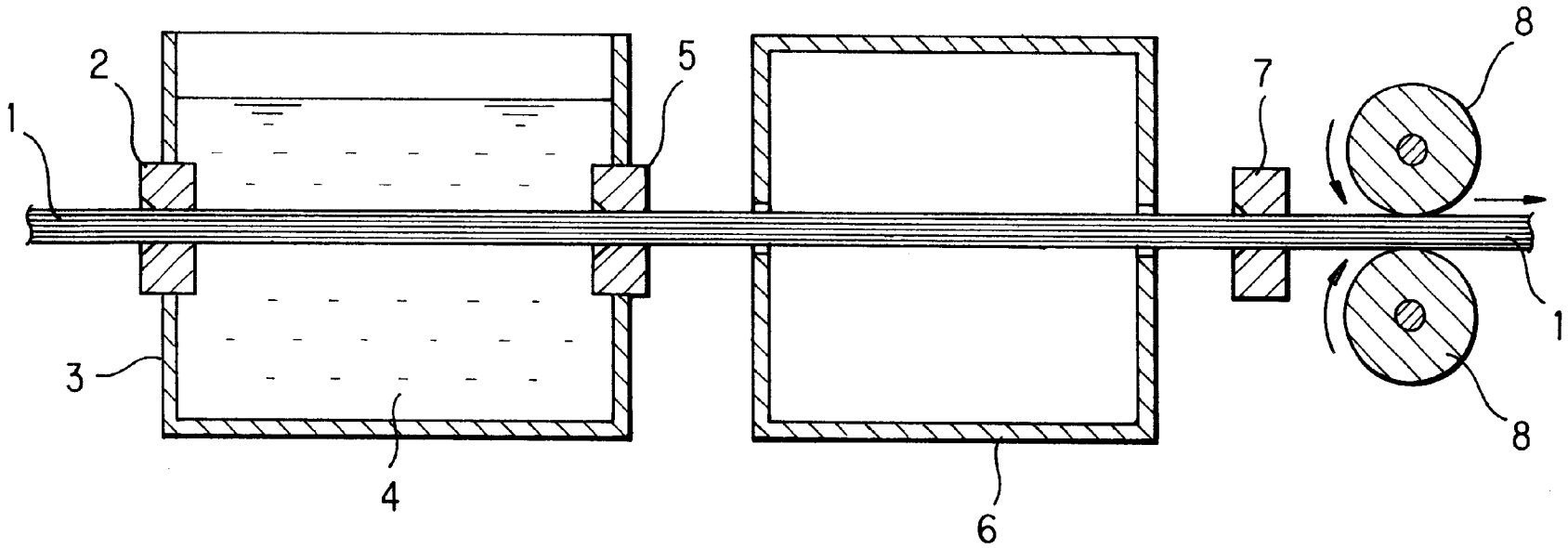
FIG. 1 is an explanatory drawing showing a state of temporarily binding the fiber bundle in the step (a) of the present invention.

FIG. 1 is the embodiment showing one example of such step (a). Fibers taken out of a bobbin meeting the prescribed number are bundled into a desired diameter (1) are introduced into a tank (3) through the dice (2) and passed through a resin solution (4) while being immersed. Then, it is guided to the outside of the tank (3) through an outlet side dice (5), and the fiber bundle (1) is further introduced into a drier (6) to volatilize the solvent in the resin solution (4), whereby the whole of the fiber bundle (1) is temporarily bound with the resin. In FIG. 1, a numeral (7) shows another dice, and a numeral (8) shows feed rollers.

The respective monofilaments used here may be straight fibers or crimp fibers having regular twists and shall not be restricted. In particular, it is preferable to apply to the crimp fibers having characteristics that an opening formed between the fibers of the resulting brush is large and a quantity of a coating liquid contained therein grows large. The liquid resin may be either a resin dissolved in a solvent or a resin heated and molten. In the case of heat-melting, the drying step in the present examples is omitted or substituted with a cooling step. With respect to a means for adhering the liquid resin on the peripheral surface of the long-size fiber bundle, it may be passed through a solution of the liquid resin as shown in FIG. 1 or may be immersed therein for a prescribed time, or the liquid resin may be sprayed on the whole peripheral surface immediately before or after it passes through the dice or may be allowed to bleed out of the inside of the dice and adhered. Not any restrictions shall be put thereon.

Figure 2:
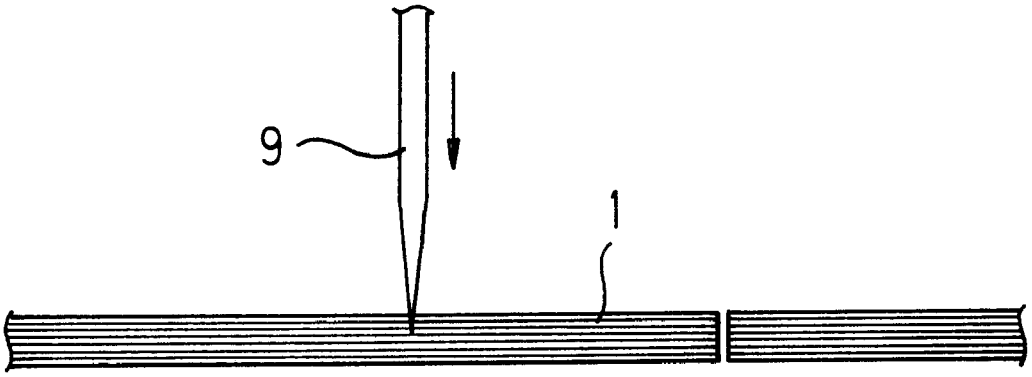
FIG. 2 is an explanatory drawing showing a state of cutting the fiber bundle in the step (b) of the present invention.
Figure 3:
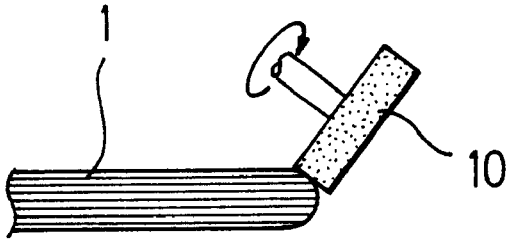
FIG. 3 is an explanatory drawing showing a state of processing a cut face at a tip side of the fiber bundle into a curved face by polishing.

Next, in step (b), the temporarily bound long-size fiber bundle is cut to a prescribed length, and the cut face thereof at a tip side is processed into a desired shape, if necessary. FIG. 2 shows one example of such step (b), and the temporarily bound fiber bundle (1) is cut to a prescribed length by means of a cutter (9). Particularly when the whole bundled fibers in the temporarily bound long-size fiber bundle are impregnated with the liquid resin in the step (a), all the bundled fibers are bound with the resin, so that such trouble that the fibers fall off is not brought about in the cutting step (b), and a brush having a fixed density can stably be produced. The tip part of the cut fiber bundle (1) is subjected, if necessary, to processing such as polishing to a curved face by means of a grinder (10) as shown in FIG. 3 or cutting to a sharpened shape by means of a cutter, to be finished to a desired shape.

Figure 4:
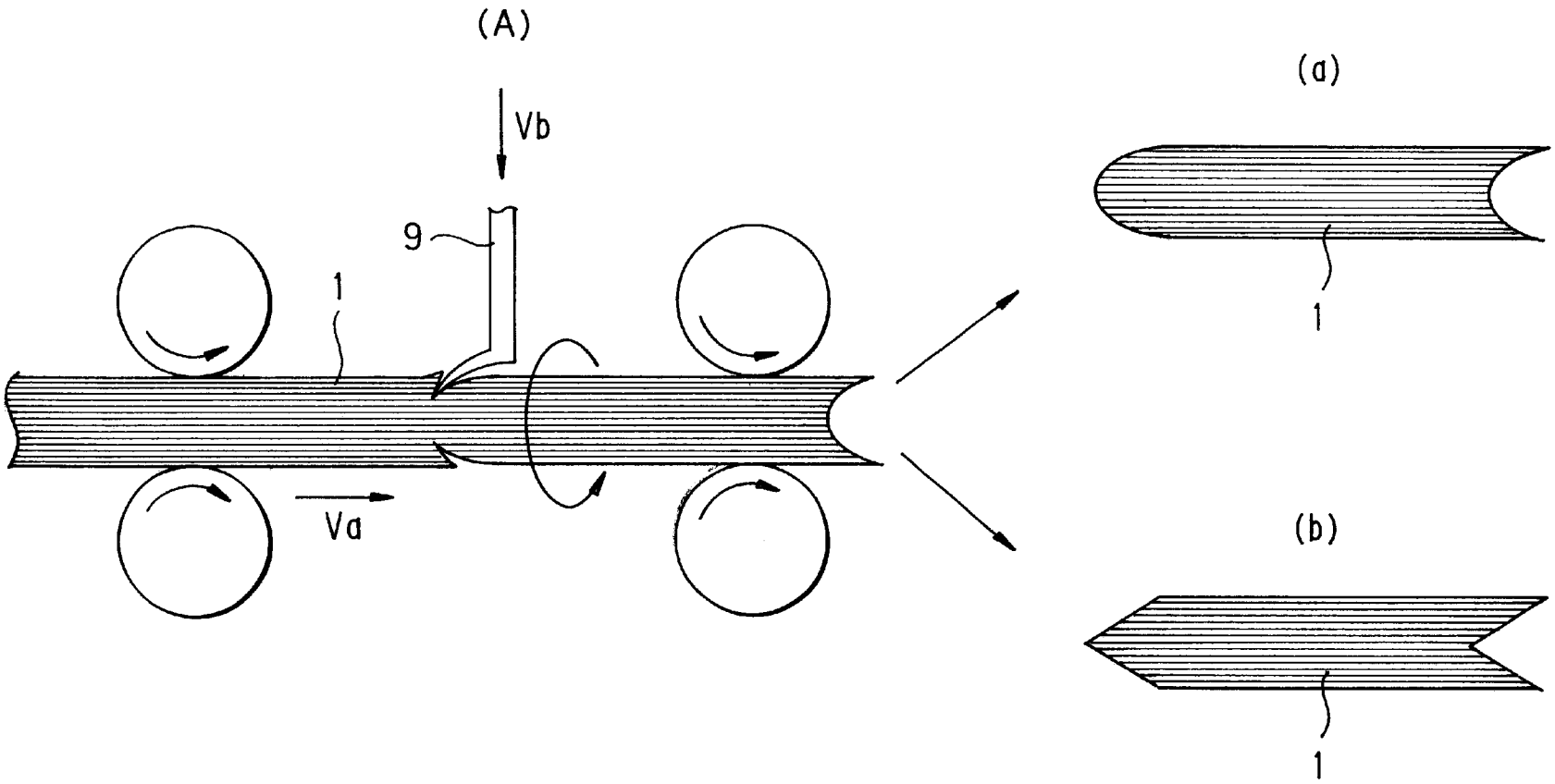
FIG. 4 is an explanatory drawing showing a state of processing the fiber bundle into a curved face by polishing by means of a cutter while rotating the fiber bundle.

As shown in FIG. 4(A), if the fiber bundle (1) is cut by moving the cutter (9) toward the center direction of the fiber bundle (1) while rotating the cutter (9) toward the circumferential direction of the fiber bundle (1), the end part of the fiber bundle (1) can be finished to a desired shape by suitably controlling a feed velocity Va of the fiber bundle (1) and a moving velocity Vb of the cutter (9), and the processing of polishing the end part by means of the grinder (10) can be omitted. For example, if Va is fixed and Vb is proportionally linearly increased, the end part can be processed to a parabolic shape as shown in FIG. 4(*a*), and if both Va and Vb are fixed, it can be processed to a sharp shape as shown in FIG. 4(*b*). In this case, the end part on an opposite side of the fiber bundle (1) is concave, but it is thermally fused in the step (c) described later and therefore brings about no problems.

Figure 5:
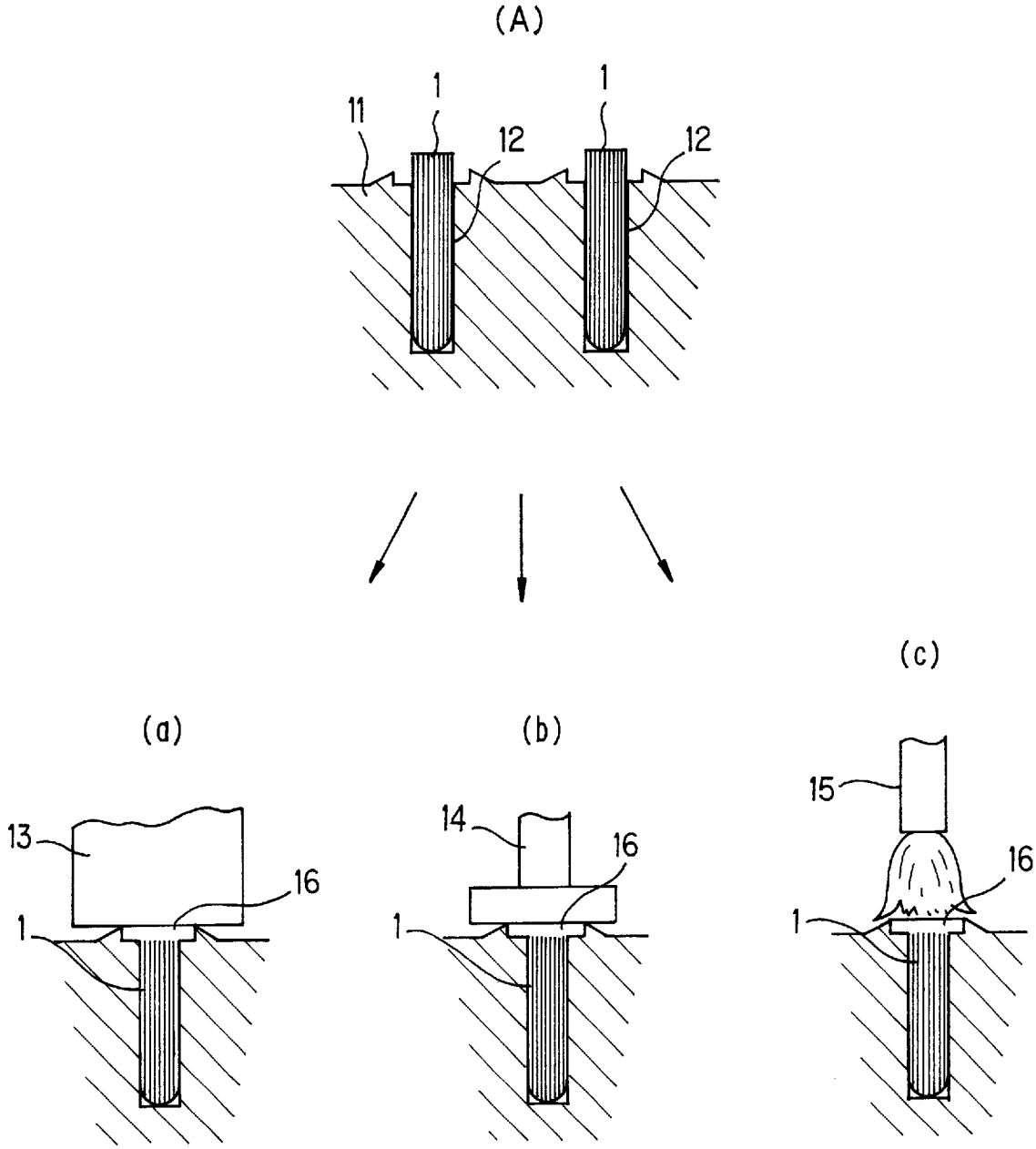
FIG. 5 is an explanatory drawing showing a state of fixing the fiber bundle and completely binding the tail end part in the step (c) of the present invention.

Next, in the step (c), the tail end part of the cut fiber bundle is completely bound by a thermally fusing means in a state of fixing the fiber bundle. FIG. 5 shows one example of such step (c), and the fiber bundle (1) is fixed by inserting into plural vertical holes (12) provided in a mold (11) with the tail end part thereof turning upward as shown in FIG. 5(A). The tail end part projecting from the above vertical hole is completely bound to form a flange (16) by applying pressure while heating and fusing by a thermally fusing means, for example, a ultrasonic welder (13), a heater (14) or a burner (15). The step (c) is efficient in that if the plural vertical holes (12) are provided in the mold (11) and the tail end parts of the plural fiber bundles (1) are fused at a stroke by one thermally fusing means, the plural tail end parts can be completely bound at the same time.

Figure 6:
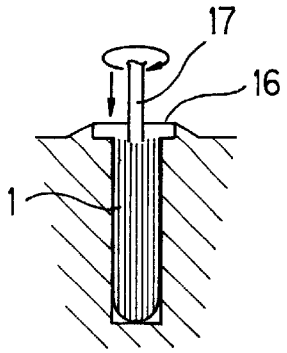
FIG. 6 is an explanatory drawing showing a state of providing a hole for inserting a liquid-introducing tube into the rear end part by means of a hollow drill after the step (c) of the present invention.
Figure 7:
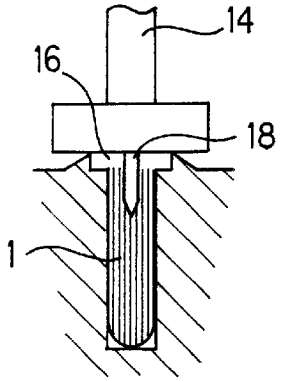
FIG. 7 is an explanatory drawing showing a state of drilling a hole at the same time as the step (c) of the present invention.

In this step (c), when a hole for inserting a liquid-introducing tube from the flange (16) formed by completely binding the tail end part of the fiber bundle (1) has to be provided, a step of drilling a hole by means of a hollow drill (17) or by pressing a heated pipe may be added as shown in FIG. 6. If the heater (14) in the step (c) described above is provided with a projection (18) as shown in FIG. 7, a hole can be drilled at the same time as the fusing step of the tail end part, and therefore this method is more efficient.

Figure 8:
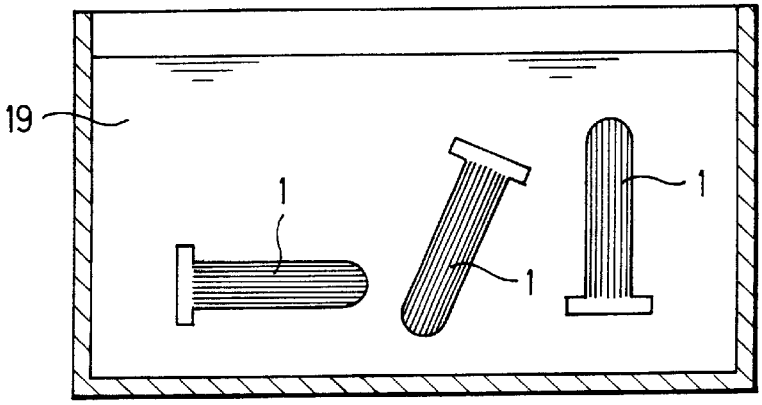
FIG. 8 is an explanatory drawing showing a state of immersing the fiber bundle in a solvent to dissolve the resin component in the step (d) of the present invention.

Next, in the step (d), the fiber bundle in which the tail end part is completely bound is dipped in a solvent capable of dissolving the resin used in the step (a) described above to dissolve and remove the resin adhered to unbind the fibers other than those in the tail end part. FIG. 8 shows one example of such step (d), and as shown in FIG. 8, the fiber bundle (1) in which the tail end part is completely bound by fusing is dipped in the solvent (19) capable of dissolving the adhered resin used in the step (a) described above to dissolve and remove the resin, whereby the fibers in the portions other than in the tail end part of the fiber bundle (1) are unbound. In this case, stirring or heating of the solvent (1) or applying a ultrasonic wave to it accelerates dissolution of the resin and therefore is efficient.

Figure 9:
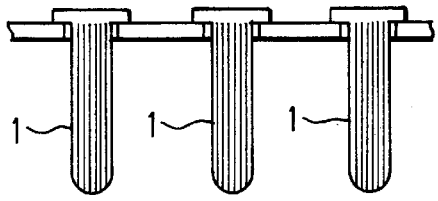
FIG. 9 is an explanatory drawing showing a state of suspending the fiber bundle to dry in the step (e) of the present invention.
Figure 10:
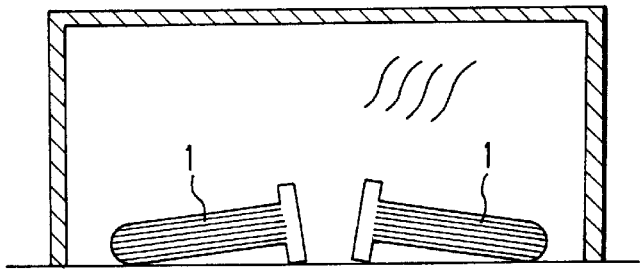
FIG. 10 is an explanatory drawing showing a state of leaving the fiber bundle sideways to dry in the step (e) of the present invention.
Figure 11:
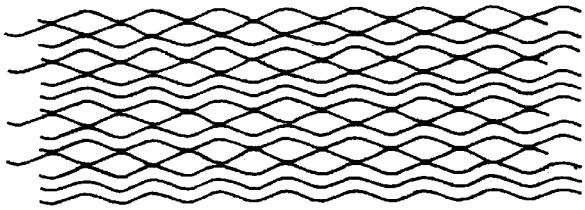
FIG. 11 is an explanatory drawing showing a state that it is difficult in a conventional process to put the end part of the crimp fibers in order.
Figure 12:
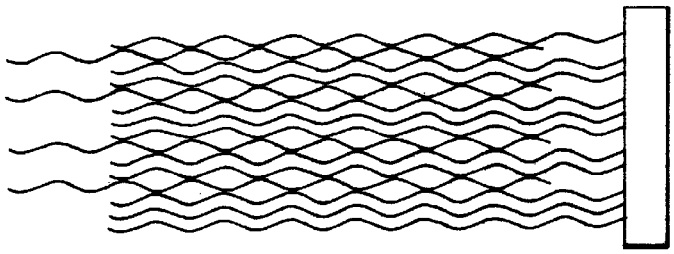
FIG. 12 is an explanatory drawing showing a state that when the end part of the crimp fibers is bound by fusing by a conventional process, the fibers which are not bound remain and the fibers fall off from the brush.

Finally, in the step (e), if necessary, this fiber bundle is taken out of the solvent and dried. FIG. 9 shows one example of such step (e), and the fiber bundle (1) is dried in a suspending state as shown in FIG. 9 or by being left sideways as shown in FIG. 10. Heating, blowing hot blast or putting the fiber bundle (1) in a vacuum or a reduced pressure atmosphere accelerates drying and therefore is effective. It may be after this step to put the shape of the brush tip in order. The shape of a cutter used in this case is suitably selected depending on the desired shape of the brush tip.

The brush is completed by consecutively combining the respective steps described above. The material of the monofilaments constituting the fiber bundle (1) has preferably a melting point falling in a range of approximately 50 to 500° C. in view of circumstances in the drying step, and capable of being used are the respective fibers of, for example, acrylic fiber, acetate, nylon, polyvinyl alcohol, polyfluorocarbon, polyurethane, polyvinyl chloride, polyethylene, polypropylene, polyethylene terephthalate and polybutylene terephthalate. Fibers which are not affected by the solvent (19) used in the step (d) have to be selected from these fibers.

In order that the resin adhered in the step (a) is dissolved into a solvent, the resin used has to be soluble in the solvent (19) used in the step (d), and examples of a combination of the resins and the solvents capable of being used in this case are given as follows.

The resins used in the step (a) are shown in front of a dotted line ( - - - ), and the solvents used in the step (d) are shown after the dotted line. These solvents may be used as well for the solvent forming the liquid resin in the step (a).

Isobutylene-maleic anhydride resin - - - DMF, DMSO
Vinylidene chloride resin - - - E (ester base solvents such as ethyl acetate and the like; the same shall apply hereinafter)
Xylene resin - - - A (aromatic base solvents such as toluene, xylene and the like; the same shall apply hereinafter) - - - K (ketone base solvents such as acetone, MEK and MIBK; the same shall apply hereinafter) - - - C (chlorine base solvents such as Trichlene and 1,1,1-trichloroethane; the same shall apply hereinafter) - - - E
Coumarone resin - - - E, K, A
Ketone resin - - - E, K, A, C
Plyethylene oxide - - - W (water; the same shall apply hereinafter)
Terpene resin - - - A, C, E
Polyvinyl alcohol - - - W
Polyvinyl ether - - - W
Cellulose acetate - - - K, C
Nitrocellulose - - - E, K
Petroleum resin - - - A
Vinyl chloride resin - - - THF, dioxane
Vinyl acetate resin - - - E, C, AL (alcohol base solvents such as ethanol and IPA; the same shall apply hereinafter)
Phenol resin - - - A, K, E
Maleic acid resin - - - E, A
Alkyd resin - - - E, A
Acryl resin - - - A
Amino resin - - - AL, A
Aliphatic base hydrocarbon resin - - - A, C, aliphatic hydrocarbons
Polyester resin - - - K
Urethane resin - - - A
Epoxy resin - - - A
Rosin-modified ester resin - - - A, E
Alicyclic saturated hydrocarbon resin - - - A, C
Fluororesin - - - A, K, E, AL
Polyamide resin - - - A
Melamine resin - - - A
Water-soluble waxy material polyethylene glycol (polymerization degree: 2000 to 4000) - - - water
Oil-soluble waxy material paraffin - - - gasoline Japan wax - - - toluene According to the present invention, first of all, the number of the fibers is set to a prescribed number to produce a brush, and therefore the fiber quantity of the brush can be fixed. Next, the liquid resins are adhered to or penetrated into at least the peripheral surface of the fiber bundle and then dried to volatilize the solvent, whereby the fiber bundle is temporarily bound, and therefore the fiber bundle is solidified in a cylindrical form. This makes it easy to cut the fiber bundle to a desired size or to process the tip part thereof to polish into a desired shape. Further, when the cut fiber bundle is inserted into the vertical hole of the mold and the tail end part thereof is fused and applied pressure, the fiber bundle maintains a fixed shape and is not bent even if the tip part of the fiber bundle hits against the bottom of the vertical hole since the whole thereof is solidified, so that scattering in the full length can be controlled.

Also when a flange is provided in the tail end part of the fiber bundle, the flange having a desired size can readily be formed for the same reason, and therefore produced is the working effect that an ancillary part is not required and the number of the parts can be reduced. Further, according to the present invention, provided are the advantages that regardless of the shape of the fibers, for example, even if the fibers are crimpy or have a modified cross-section, a brush can easily be produced by temporarily binding; the whole of the fiber bundle is temporarily bound, and the tail end part thereof is completely bound, so that when a hole for a liquid-introducing tube is required in the tail end part of the fiber bundle, the drilling can very readily be carried out after binding; and a brush having an optional cross section can easily be obtained depending on the shape of the hole of the dice in the step of temporarily binding the fiber bundle, that is, in the step (a), and a brush having, for example, a modified cross-section can be produced.

EXAMPLES

Example 1

Bundled almost parallel into a desired diameter were 2000 filaments of crimp fibers which have a diameter of 0.06 mm ϕ and in which a monofilament comprises a PBT resin, and a hydroxyethyl cellulose resin dissolved in a solvent (ethanol) is adhered to a circumferential surface of the-bundle. Then the bundle is dried to obtain a long-size fiber bundle in which the whole was temporarily bound. The long-size fiber bundle was cut to a size of 3 cm, and the tail end part of the cut bundle was completely bound by a thermally fusing means of a heater heated to 350° C. to form a flange with the tip end part fixed. Then, a hole for a liquid-introducing tube was drilled by means of a hollow drill. This was immersed in a solvent, ethanol, and stirred to dissolve and remove the resin in the portion cut out by the hollow drill together with the adhered resin, and it was taken out from the solvent and dried. As a result, it was confirmed that the monofilaments are completely stuck to the flange in the tail end part without falling off.

This brush was used as a brush for a manicure cosmetic tool, and as a result, it was confirmed that the fibers did not fall off from the brush during application of a coating liquid and that the above brush is particularly suited as a brush of crimp fibers in which an opening formed between the fibers is large and a quantity of the coating liquid contained therein is large.

What is claimed is:

1. A production process of a brush for a cosmetic tool or writing instrument, comprising a consecutive combination of:

(a) a step of bundling a prescribed number of fibers into a desired diameter, applying a liquid resin or waxes at least on a peripheral surface thereof and then drying it to form a fiber bundle in which the whole is temporarily bound, (b) a step of cutting the temporarily bound fiber bundle into a prescribed size, (c) a step of completely binding a tail end part of the cut fiber bundle by a thermally fusing means while fixing the fiber bundle, and (d) a step of dipping the fiber bundle in which the tail end part is completely bound into a solvent capable of dissolving the resin or waxed used in the step (a) described above to dissolve and remove the resin or wax adhered to unbind the fibers other than those in the tail end part.

2. The production process of the brush as described in claim 1, wherein crimp fibers are used as the fibers bundled into a desired diameter in the step (a).

3. The production process of the brush as described in claim 1, wherein in step (c), the plural fiber bundles are inserted into vertical holes provided in a mold and are fixed therein, the tail end parts thereof projected from said vertical holes are completely bound by a thermally fusing means to form a flange.

* * * * *